US005415993A

United States Patent [19]

Hanzalik et al.

[11] Patent Number: 5,415,993

[45] Date of Patent: May 16, 1995

[54] THERMOREVERSIBLE ORGANOGELS FOR PHOTOTHERMOGRAPHIC ELEMENTS

[75] Inventors: Kenneth L. Hanzalik, Arden Hills; George H. Crawford, Jr., White Bear Lake; Sharon M. Rozzi, Stillwater, all of Minn.; David J. Scanlan, Fairport, N.Y.

[73] Assignee: Minnesota Mining and Manufacturing Company, Saint Paul, Minn.

[21] Appl. No.: 198,531

[22] Filed: Feb. 17, 1994

Related U.S. Application Data

[63] Continuation-in-part of Ser. No. 52,898, Apr. 26, 1993, abandoned.

[51] Int. Cl.[6] ..... G03C 1/015; G03C 1/498; G03C 1/494; G03C 1/79

[52] U.S. Cl. ..... 430/619; 430/203; 430/217; 430/617; 430/627; 430/935

[58] Field of Search ..... 430/203, 217, 617, 619, 430/627, 935

[56] References Cited

U.S. PATENT DOCUMENTS

| | | | |
|---|---|---|---|
| 2,419,008 | 4/1947 | Coffman et al. | 260/88 |
| 2,647,296 | 8/1953 | Shive | 28/74 |
| 2,647,488 | 8/1953 | Shive | 118/44 |
| 2,749,998 | 5/1956 | Val Sayre | 430/627 |
| 3,139,470 | 6/1964 | Prengle et al. | 264/285 |
| 3,180,731 | 4/1965 | Roman et al. | 96/29 |
| 3,457,075 | 7/1969 | Morgan et al. | 96/67 |
| 3,531,286 | 9/1970 | Renfrew | 96/67 |
| 3,637,391 | 1/1972 | Saleck et al. | 430/627 |
| 3,761,270 | 9/1973 | deMauriac et al. | 96/77 |
| 3,847,654 | 11/1974 | Althouse et al. | 117/123 D |
| 3,852,096 | 12/1974 | Lundberg et al. | 117/47 H |
| 3,920,862 | 11/1975 | Damschroder et al. | 427/131 |
| 3,985,565 | 10/1976 | Gabrielson | 430/203 |
| 4,022,617 | 5/1977 | McGuckin | 96/29 |
| 4,113,903 | 9/1978 | Choinski | 427/420 |
| 4,173,506 | 11/1979 | Pletcher | 156/309 |
| 4,187,108 | 2/1980 | Willis | 430/203 |
| 4,218,533 | 8/1980 | Fuchigami et al. | 430/935 |
| 4,260,677 | 4/1981 | Winslow et al. | 430/618 |
| 4,374,921 | 2/1983 | Frenchik | 430/338 |
| 4,384,015 | 5/1983 | Koepke et al. | 427/402 |
| 4,426,441 | 1/1984 | Adin et al. | 430/351 |
| 4,440,811 | 4/1984 | Hitaka et al. | 427/402 |
| 4,460,681 | 7/1984 | Frenchik | 430/502 |
| 4,525,392 | 6/1985 | Ishizaki et al. | 430/935 |
| 4,584,267 | 4/1986 | Masukawa et al. | 430/619 |
| 4,684,551 | 8/1987 | Vassiliou | 427/345 |
| 4,770,989 | 9/1988 | Komamura et al. | 430/619 |
| 4,791,004 | 12/1988 | Suzuki et al. | 427/54.1 |
| 4,883,747 | 11/1989 | Grieve et al. | 430/542 |
| 4,966,792 | 10/1990 | Terai et al. | 427/420 |
| 4,981,775 | 1/1991 | Swain et al. | 430/203 |
| 5,097,792 | 3/1992 | Umemura et al. | 118/314 |
| 5,188,789 | 2/1993 | Nishiura | 264/171 |
| 5,202,162 | 4/1993 | Hart, Jr. et al. | 427/282 |

FOREIGN PATENT DOCUMENTS

| | | |
|---|---|---|
| 0011392A1 | 5/1980 | European Pat. Off. . |
| 2063500 | 6/1981 | United Kingdom . |

OTHER PUBLICATIONS

United States Statutory Invention Registration No. H1003, Dec. 3, 1991, Ishiwata et al.

Research Disclosure 29963, Mar. 1989, pp. 208–214, by Paul W. Lauf.

"Photothermographic silver halide systems", J. W. Carpenter et al., *Research Disclosure,* vol. 170, No. 29, Jun. 1978, pp. 9–13.

"Structure and Stability of Microemulsion-based Organo-gels", P. J. Atkinson et al., *J. Chem. Soc. Faraday Trans.,* 1991, vol. 87, No. 20, pp. 3389–3397.

*Primary Examiner*—Charles L. Bowers, Jr.

*Assistant Examiner*—J. Pasterczyk

*Attorney, Agent, or Firm*—Gary L. Griswold; Walter N. Kirn; Gregory A. Evearitt

[57] ABSTRACT

A photographic emulsion containing: a photosensitive silver halide; a light-insensitive, reducible silver source; a reducing agent for the light-insensitive, reducible silver source; and a binder consisting essentially of poly(vinyl butyral) having a poly(vinyl alcohol) content of about 17.5 to 21.0 wt. % and at least one solvent selected from the group consisting of: toluene, methyl ethyl ketone, acetone, tetrahydrofuran, and 1,4-dioxane. Additionally, a process for coating a substrate involving applying at least one layer of a molten thermoreversible organogel layer; causing it to gel; and removing residual solvent.

15 Claims, No Drawings

THERMOREVERSIBLE ORGANOGELS FOR PHOTOTHERMOGRAPHIC ELEMENTS

This is a continuation-in-part application of U.S. application Ser. No. 08/052,898, filed Apr. 26, 1993, now abandoned.

BACKGROUND OF THE INVENTION

1. Field of Invention

This invention relates to light-sensitive photothermographic emulsion layers containing a thermoreversible organogel based binder. This invention also relates to processes for the application of photothermographic coatings to a substrate and more particularly, it relates to a process for the application of at least one layer of a molten, thermoreversible organogel to a substrate.

2. Background to the Art

Photothermographic imaging materials (i.e., heat-developable photographic materials) that are classified as "dry silver" compositions or emulsions comprise: (1) a photosensitive material that generates atomic silver when irradiated, (2) a light-insensitive, reducible silver source, and (3) a reducing agent for the reducible silver source. The light-sensitive material is generally photographic silver halide which must be in catalytic proximity to the light-insensitive, reducible silver source. Catalytic proximity requires an intimate physical association of these two materials so that when silver specks or nuclei are generated by the irradiation or light exposure of the photographic silver halide, those nuclei are able to catalyze the reduction of the reducible silver source. It has long been understood that atomic silver ($Ag^{\circ}$) is a catalyst for the reduction of silver ions, and a progenitor of the light-sensitive photographic silver halide may be placed into catalytic proximity with the light-insensitive, reducible silver source in a number of different fashions, such as partial metathesis of the reducible silver source with a halogen-containing source (see, for example, U.S. Pat. No. 3,457,075), coprecipitation of silver halide and reducible silver source material (see, for example, U.S. Pat. No. 3,839,049), and other methods that intimately associate the light-sensitive photographic silver halide and the light-insensitive, reducible silver source.

The light-insensitive, reducible silver source is a material that contains silver ions. The preferred light-insensitive reducible silver source comprises silver salts of long chain aliphatic carboxylic acids, typically having from 10 to 30 carbon atoms. The silver salt of behenic acid or mixtures of acids of similar molecular weight are generally used. Salts of other organic acids or other organic materials, such as silver imidazolates have been proposed, and U.S. Pat. No. 4,260,677 discloses the use of complexes of inorganic or organic silver salts as light-insensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image generally is not visible by ordinary means and the light-sensitive emulsion must be further processed in order to produce a visible image. The visible image is produced by the reduction of silver ions, which are in catalytic proximity to silver halide grains bearing the clusters of silver atoms, i.e. the latent image. This produces a black and white image.

As the visible image is produced entirely by silver atoms ($Ag^{\circ}$), one cannot readily decrease the amount of silver in the emulsion without reducing the maximum image density. However, reduction of the amount of silver is often desirable in order to reduce the cost of raw materials used in the emulsion.

One conventional way of attempting to increase the maximum image density of photographic and photothermographic emulsions without increasing the amount of silver in the emulsion layer is by incorporating dye-forming materials in the emulsion. Color images can be formed by incorporation of leuco dyes into the emulsion. Leuco dyes are the reduced form of a color-bearing dye. Upon imaging, the leuco dye is oxidized, and the color-bearing dye and a reduced silver image are simultaneously formed in the exposed region. In this way a dye enhanced silver image can be produced, as shown, for example, in U.S. Pat. Nos. 3,531,286; 4,187,108; 4,426,441; 4,374,921; and 4,460,681.

Multicolor photothermographic imaging articles typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic articles having at least 2 or 3 distinct color-forming emulsion layers are disclosed in U.S. Pat. Nos. 4,021,240 and 4,460,681. Various methods to produce dye images and multicolor images with photographic color couplers and leuco dyes are well known in the art as represented by U.S. Pat. Nos. 4,022,617; 3,531,286; 3,180,731; 3,761,270; 4,460,681; 4,883,747; and *Research Disclosure* 29963.

Simultaneous multilayer coating of aqueous gelatin/silver halide emulsions ("photographic emulsions") has been used extensively in the manufacture of photographic films. Photographic emulsions contain aqueous gelatin solutions containing dispersed silver halide grains. In color photographic emulsions, there are present color couplers which are spectrally matched to the sensitization of the silver halide grains. These color couplers are, in turn, contained in dispersed droplets of a water insoluble oil. The individual color coupler molecules have attached oleophilic "hallasting groups", such as tertiary amyl groups, which ensure that the coupler molecule remains dissolved in the oil droplet rather than dissolving into the aqueous phase from which it can undergo interlayer diffusion.

It is essential that the color couplers remain confined within their assigned layers in close association with their correspondingly sensitized silver halide grains. Were the coupler to migrate into a different color layer and react with the wrong silver halide grain, false color renderings would occur (commonly known as "cross-talk").

Simultaneous multilayer coating has the primary advantage of reducing the number of coating steps needed to prepare multi-layered articles. The process for simultaneously applying aqueous gelatin emulsions to form a multilayer film generally involves extruding gelatin emulsions at a temperature above their gel point and then simultaneously coating the extruded gelatin solutions onto a moving web using a coating apparatus (e.g., a slide-hopper). Upon contact with the web, the gelatin-based layers are rapidly cooled below their gel temperature, thereby gelling the individual layers (wherein a rapid qualitative change from liquid to solid properties occurs) and minimizing drying related defects, especially mottle. Subsequently, the coated gelled film is dried to remove excess water.

In conventional polymer solution coating operations (regardless of whether the coating solvent is water or an organic solvent) the newly applied coating undergoes a progressive change from liquid to solid as the solvent evaporates. The evaporation process produces a viscosity change as the polymer concentration increases. Ideally, this viscosity increase would be uniform throughout the coated layer and that layer would be uniformly converted from a liquid layer to a solid film attached to the substrate. Unfortunately, depending upon the evaporation characteristics of the solvent, there is a tendency for the coating to lose solvent more rapidly at or near the surface. This phenomenon and attendant shrinkage applies non-uniform physical stresses to the drying layer. This can be used to produce novel and desirable effects such as a "crinkle finish" on painted surface. More often, the effect is undesirable (e.g., "orange peel" in the automotive paint field). In polymeric coatings applied to a moving substrate, this is manifested as striations or mottle which is analogous to the aforementioned "orange peel". When the coating solvent is a volatile organic solvent of high vapor pressure, the tendency is amplified.

When the coating is rapidly converted to a solid, prior to solvent evaporation, the coating resists stress deformation and the defects caused thereby. The field of gelatin/silver halide photography has taken advantage of this by utilizing the ability of molten gelatin emulsions to "chill set" to a solid gel from which the solvent (water) diffuses while maintaining the original smooth topography of the coating.

Gelation allows greater flexibility in the coating and drying process, allowing for drying conditions with higher air flow rates and conditions that in a non-gelling coating would be very difficult. "Air turnarounds," commonly used in photographic drying operations to avoid roller contact with the gel layer, would be impossible in a non-gelling coating. The layer would be blown off the substrate. The advantages of gel coating become more apparent as the wet thickness of single coatings or the number of simultaneously coated layers increases.

Until now, there has been no disclosure of simultaneously applying organic solvent-based coatings, which can be cooled to organogels, to suitable substrates.

U.S. Pat. No. 4,966,792 describes stacked aqueous gel-forming solutions (e.g., acrylamides) of varying concentration gradients for use in electrophoresis. There is no disclosure of using non-aqueous-based gels.

U.S. Pat. No. 4,525,392 discloses a method for simultaneously applying multiple layers of gelatin solutions to a web. A slide-hopper type coating apparatus is used to coat the solutions. Interlayer mixing is controlled by adjusting the relative flow viscosities of the aqueous gelatin layers flowing on the slide surface.

U.S. Pat. No. 4,384,015 and U.S. Statutory Invention Registration H1003 disclose processes for the simultaneous coating of multiple aqueous gelatin-based layers for photographic applications.

U.S. Pat. No. 3,920,862 discloses multilayer coating of aqueous gelatin solutions incorporating a stripe of recording material.

U.S. Pat. No. 4,791,004 discloses a method for forming multi-layered coated articles by increasing the viscosity of a coated solution followed by a lamination step.

U.S. Pat. No. 4,684,551 discloses an apparatus useful for coating thixotropic polyvinyl fluoride as a plastisol in a latent solvent (i.e., a liquid dispersing agent that becomes a true solvent upon heating). No mention of multiple coatings is made.

U.S. Pat. Nos. 2,647,296 and 2,647,488 disclose a method for coating textile fabric with a polymeric plastisol composition.

U.S. Pat. Nos. 2,419,008, 2,419,010, 2,510,783, 2,599,300, 2,953,818, and 3,139,470 disclose processes for the manufacture of films from orientable polyvinyl fluoride. Those processes involve extrusion of polyvinylidene fluoride dissolved in a solvent. A solvent is mixed with polyvinylidene fluoride and heated until the polyvinyl fluoride particles coalesce. The uniform mixture is extruded and upon rapid cooling forms a self-supporting film which can be further dried.

U.S. Pat. No. 4,281,060 discloses the use of polyisocyanate hardeners to improve multilayer coatability of silver halide-containing photothermographic layers having poly(vinyl butyral) binders.

European Patent Application No. 388,818 discloses a dual slot extrusion coating die for use with non-aqueous coating compositions.

U.S. Pat. No. 3,985,565 (to Gabrielsen et al.) discloses photothermographic elements containing binders with poly(vinyl butyral) dissolved in organic solvents such as acetone/toluene blends, but with the subsequent addition of methanol no gelation will actually occur as demonstrated by various example later herein.

U.S. Pat. No. 4,022,617 (to McGuckin) also discloses a photothermographic element wherein a binder is employed containing poly(vinyl butyral) dissolved in an acetone/toluene solvent blend, but with the subsequent addition of ethanol no gelation will actually occur as demonstrated by example later herein.

What would be desirable in the industry is light-sensitive photothermographic emulsions layers containing an organogel based binder. What would also be desirable in the industry is a process for the preparation of light-sensitive photothermographic emulsion layers containing a thermoreversible organogel based binder.

SUMMARY OF THE INVENTION

The present invention provides heat-developable, photothermographic elements capable of providing stable, high density images of high resolution. These elements comprise a support bearing at least one light-sensitive, image-forming photothermographic emulsion layer composition comprising:

(a) a photosensitive silver halide,
(b) a light-insensitive, reducible silver source;
(c) a reducing agent for the light-insensitive reducible silver source; and
(d) a binder consisting essentially of: poly(vinyl butyral) having a poly(vinyl alcohol) content of about 17.5 to 21.0 wt. % and at least one solvent selected from toluene, methyl ethyl ketone, acetone, tetrahydrofuran, and 1,4-dioxane.

The reducing agent for the light-insensitive silver source may optionally comprise a compound capable of being oxidized to form or release a dye. Preferably, the dye forming material is a leuco dye.

In another embodiment, the present invention provides a process for the application of thermoreversible organogels to substrates. The inventive process comprises the steps of: (a) applying at least one molten thermoreversible organogel layer to a substrate, the organogel layer comprising: (i) a photosensitive silver halide; (ii) a light-insensitive reducible silver source; and, (iii) a reducing agent for the light-insensitive reducible silver source; (b) chilling the coated, molten thermoreversible organogel layer thereby causing it to gel; and (c) removing residual solvent. Optionally, the reducing agent for the light-insensitive silver source can comprise a compound capable of being oxidized to form or release a dye. Preferably, the dye-forming material is a leuco dye.

The present invention provides a low cost, efficient method for coating multiple, non-aqueous-based layers containing a photothermographic imaging system. Other aspects, advantages, and benefits of the present invention are apparent from the detailed description, examples, and claims. We have also found that when organogel polymer solutions undergo a "chill setting" process, coating defects are minimized.

As used herein:

"gel" means a mixture of a solvent and polymer network wherein the polymer network is formed through physical aggregation of the polymer chains through hydrogen bonds or other bonds of comparable strength.

"hydrogel" means a gel in which the solvent (diluent) is water;

"organogel" means a gel in which the solvent (diluent) is an organic solvent (as opposed to water);

"thermoreversible organogel" is synonymous with "physical organogel" and means an organogel whose network structure is due to weak, thermally unstable bonding such as hydrogen bonding (as opposed to strong, thermally stable bonds such as covalent bonds) and can, therefore, be heated to a free-flowing, liquid (molten) state. (Upon cooling below a characteristic temperature ($T_{gel}$), the bonds reform and the solid-like gel structure is re-established.);

"chill-setting" means forced cooling to expedite the transition from the molten to the solid gel state; and "emulsion layer" means a layer of a photothermographic element that contains photosensitive silver halide; a light-insensitive reducible silver source; and a reducing agent for the reducible silver source such as, for example, a leuco dye.

DETAILED DESCRIPTION OF THE INVENTION

The photothermographic element of this invention comprises at least one photothermographic emulsion layer comprising: (1) a photosensitive silver halide, (2) a light-insensitive, reducible silver source; (3) a reducing agent for the light-insensitive, reducible silver source; and (4) a binder consisting essentially of poly(vinyl butyral) having a poly(vinyl alcohol) content of from about 17.5 to 21.0 wt. % and at least one solvent selected from toluene, methyl ethyl ketone, acetone, tetrahydrofuran, and 1,4-dioxane. Optionally, the reducing agent for the reducible silver source may comprise a compound capable of being oxidized to form or release a dye. Preferably, the dye forming material is a leuco dye.

The photothermographic elements of this invention may be used to prepare black and white, monochrome, or full color images. The photothermographic material of this invention can be used, for example, in conventional black and white or color photothermography, in electronically generated black and white or color hardcopy recording, in the graphic arts area, and in digital color proofing. The material of this invention provides high photographic speed, provides strongly absorbing black and white or color images, and provides a dry and rapid process.

Multi-layer constructions containing blue-sensitive emulsions containing a yellow leuco dye of this invention may be overcoated with green-sensitive emulsions containing a magenta leuco dye of this invention. These layers may in turn be overcoated with a red-sensitive emulsion layer containing a cyan leuco dye. Imaging and heating form the yellow, magenta, and cyan images in an imagewise fashion. The dyes so formed may migrate to an image-receiving layer. The image-receiving layer may be a permanent part of the construction or may be removable "i.e., strippably adhered." and subsequently peeled from the construction. Color-forming layers may be maintained distinct from each other by the use of functional or non-functional barrier layers between the various photosensitive layers as described in U.S. Pat. No. 4,460,681. False color address, such as that shown in U.S. Pat. No. 4,619,892 may also be used rather than blue-yellow, green-magenta, or red-cyan relationships between sensitivity and dye formation.

The Organogel Binder

According to the present invention, the molten (liquid) organogels are coated above their gelation temperatures ($T_{gel}$). As is understood in the art, the $T_{gel}$ is the temperature at which gel-to-sol transition occurs. It is preferred that the $T_{gel}$ of the molten coating compositions be about between 20° C. and 70° C. It is also preferred that the molten coating compositions be coated from about 5° C. to 25° C. above the $T_{gel}$ of the coating composition with the highest $T_{gel}$.

Generally, a thermoreversible organogel is characterized by the observation of a $T_{gel}$. The $T_{gel}$ may be determined by several different criteria, such as, for example, the temperature at which: (a) when a liquid composition is cooled, there is a rapid, discrete, qualitative change from liquid to solid properties; (b) when a liquid composition is cooled, there is a sudden increase in hydrodynamic radius, as measured by dynamic light scattering methods; (c) when a liquid composition is warmed, a 1 mm drop of mercury will flow through the composition; and (d) the elastic and viscous moduli are equivalent.

Non-limiting examples of liquid compositions that form thermoreversible organogels at or near room temperature are amine-substituted polystyrene in tetrahydronapthalene; vinylidene chloride/methyl acrylate copolymers in benzene, toluene, chlorobenzene, m-dichlorobenzene, or o-dichlorobenzene; acrylonitrile/-vinyl acetate copolymers in dimethylacetamide; poly(-vinyl chloride) in dioctyl phthalate or dibutyl phthalate; poly(acrylonitrile) in dimethylformamide or dimethylacetamide; nitrocellulose in ethyl alcohol; and poly(-methyl methacrylate) in N,N-dimethylformamide; and poly(vinyl butyral) in toluene, methyl ethyl ketone, acetone, tetrahydrofuran, 1,4-dioxane, and blends thereof.

Especially preferable thermoreversible gels for use in the present invention are gels of poly(vinyl butyral) in mixtures of toluene and 2-butanone, i.e., methyl ethyl ketone or MEK.

Although not wishing to be bound by theory, Applicants postulate that thermoreversible organogels suitable for use in the present invention may contain a polymer or copolymer wherein the polymer or copolymer chain contains two or more different functional groups or discrete regions, e.g., syndiotactic sequences prone to crystallite formation in a solvent or solvent mixture. It is believed that the addition of methanol or other alcohols to poly(vinyl butyral) prevents or reverses gel formation because of the hydrogen bonding of the poly(vinyl alcohol) sites of poly(vinyl butyral) with alcohol-based solvents.

Organogels of poly(vinyl butyral) may be prepared by combining poly(vinyl butyral) polymers preferably having a high hydroxyl content with an appropriate solvent blend. Non-limiting examples of useful poly(vinyl butyral) polymers include Butvar TM B-72, Butvar TM B-73, Butvar TM B-74, Butvar TM B-90, and Butvar TM B-98 (all available from Monsanto Company, St. Louis, Mo.). Especially useful are Butvars TM which have a poly(vinyl alcohol) content of from about 17.5 to 21.0 weight percent. The requirements of the solvent blend are that it must not interact with poly(vinyl alcohol) sites along the polymer chain and thereby interfere with the polymeric binder's ability to undergo hydrogen bonding with itself through the hydroxyl groups, yet it must solvate the polymer at the non-hydroxyl sites and be an overall solvent for the polymer at temperatures above $T_{gel}$. A further requirement is that upon cooling below $T_{gel}$ the polymer remains in solution forming a gel which is a homogeneous, clear, solid solution as opposed to forming an opaque heterogeneous mass.

In coating molten thermoreversible organogel solutions, it is necessary to coat at temperatures above the $T_{gel}$ of the organogel. On the other hand, it is desirable to perform the coating at the lowest possible temperature above $T_{gel}$ in order to facilitate rapid onset of gelation after coating. It has been found advantageous to provide a "chili-box" or similar rapid chilling mechanism which functions immediately after the coating operation to trigger rapid gelation to inhibit interlayer mixing. Preferably, the molten organogel temperatures during coating should be 5° C. to 25° C. above $T_{gel}$. More preferably, the molten organogel temperatures during coating should be from about 10° C. to about 15° C. above $T_{gel}$.

The coating solutions or dispersions are solidified organogels at or near room temperature and liquids at a modestly elevated temperature. The solutions are warmed to 5° C. to 25° C. above their $T_{gel}$ so that they are liquids. The molten solutions are simultaneously applied onto a web by extrusion (e.g., by curtain coating; by slide coating, such as disclosed in U.S. Statutory Invention Registration H1003; or by slot coating as disclosed in U.S. Pat. No. 4,647,475, the disclosures of which are hereby incorporated by reference). The solutions may also be applied to the web by knife coating, but extrusion is preferred. Once the layers are on the web, the coated layers are rapidly cooled below $T_{gel}$, preferably by a "chill-set" device as disclosed earlier herein.

A typical slide coating apparatus consists of a multilayer slide coating die tilted, for example, at an angle of 35°. The feed solutions, pumps, and hoppers are immersed in a constant temperature bath maintained at approximately 65° C. The feed lines and coating die are jacketed with hot water circulated from this water bath. A chill box is mounted approximately one foot from the coating die and maintained at a temperature sufficiently below the lowest $T_{gel}$ of the solutions containing the multi-layer coating so as to produce rapid "chill setting", e.g., 0° C. to −70° C. The use of cold air moving over the surface of the coating enhances the "chill set" effect by evaporative cooling of the volatile solvent.

An advantage of the thermoreversible organogels used in the present invention is that they often undergo chill-setting more rapidly than equivalent (in terms of concentration, bloom number, and $T_{gel}$) aqueous gelatin solutions, provided an adequate chill box is employed.

Typical web speeds are from about 1 to 1000 ft./min., preferably from about 50 to 400 ft./min. and wet coating thicknesses range from about 1 to 300 μm, preferably from about 12 to 120 μm per layer.

In addition, extrusion-type coating can be used to practice the present invention. Two or more kinds of non-aqueous coating solutions are fed to a coating head from liquid reservoirs by quantitative liquid transfer pumps. The coating solutions are applied to a continuously traveling web at an extrusion bead-forming area. This multilayer-type coating procedure is called extrusion-type coating because the coating liquid compositions are extruded onto a continuously traveling web.

A single- or multi-blade knife-type coating apparatus can also be used in a method of the present invention. Such apparatus are well known to those skilled in the art and are commercially available.

In the methods of the present invention, the molten organogels have viscosities between about 15 and 100 centipoise at a shear rate of 100 $sec^{-1}$ at the temperature at which they are coated.

After the application of the molten organogels to the web, the organogels are cooled to a temperature below the $T_{gel}$ of the organogel to solidify the layers. The time until arrival at the chilling device after formation of the multilayer coated film is related to the properties of the coating solution, but the time preferably is within 5 seconds.

Drying of organogel coated articles prepared according to the present invention may be accomplished by means widely known in the coating arts including, but not limited to, oven drying, forced air drying, drying under reduced pressure, etc.

The Photosensitive Silver Halide

The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver. The photosensitive silver halide is preferably present at a level of 0.01 to 15 percent by weight of the emulsion layer, although higher amounts, e.g., up to 20 to 25 percent, are useful. It is more preferred to use from 1 to 10 percent by weight photosensitive silver halide in the emulsion layer and most preferred to use from 1.5 to 7.0 percent by weight. The photosensitive silver halide can be chemically and spectrally sensitized in a manner similar to that used to sensitize conventional wet process silver halide or state-of-the-art heat-developable photographic materials.

The light sensitive silver halide used in the present invention can be employed in a range of 0.005 mol to 0.5 mol and, preferably, from 0.01 mol to 0.15 mol per mole of silver salt. The silver halide may be added to the emulsion layer in any fashion which places it in catalytic proximity to the silver source.

The silver halide used in the present invention may be employed without modification. However, it may be chemically sensitized with a chemical sensitizing agent such as a compound containing sulfur, selenium or tellurium etc., or a compound containing gold, platinum, palladium, ruthenium, rhodium or iridium, etc., a reducing agent such as a tin halide, etc., or a combination thereof. The details of these procedures are described in T. H. James *The Theory of the Photographic Process,* Fourth Edition, Chapter 5, pages 149 to 169.

The light-sensitive silver halides may be spectrally sensitized with various known dyes that spectrally sensitizes silver halide. Non-limiting examples of sensitizing dyes that can be employed include cyanine dyes merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally in the range of from about $10^{-10}$ to $10^{-1}$ mole, and preferably from about $10^{-8}$ to $10^{-3}$ moles per mole of silver halide.

The Light-Insensitive Silver Source Material

The light-insensitive, reducible silver source can be any material that contains a source of reducible silver ions. Silver salts of organic acids, particularly silver salts of long chain fatty carboxylic acids, are preferred. The chains typically contain 10 to 30, preferably 15 to 28 carbon atoms. Complexes of organic or inorganic silver salts, wherein the ligand has a gross stability constant for silver ion of between 4.0 and 10.0, are also useful in this invention. The source of reducible silver material generally constitutes from 20 to 70 percent by weight of the emulsion layer. It is preferably present at a level of 30 to 55 percent by weight of the emulsion layer.

The organic silver salt which can be used in the present invention is a silver salt which is comparatively stable to light, but forms a silver image when heated to 80° C. or higher in the presence of an exposed photocatalyst (such as silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of compounds containing mercapto or thione groups and derivatives thereof can be used. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, a silver salt of thioglycolic acid such as a silver salt of a S-alkylthioglycolic acid (wherein the alkyl group has from 12 to 22 carbon atoms) as described in Japanese patent application No. 28221/73, a silver salt of a dithiocarboxylic acid such as a silver salt of dithioacetic acid, a silver salt of thioamide, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1,2,4-thiazole, a silver salt of a thione compound such as a silver salt of 3-(2-carboxyethyl)-4-methyl-4-thiazoline-2-thione as disclosed in U.S. Pat. No. 3,201,678.

Furthermore, a silver salt of a compound containing an imino group can be used. Preferred examples of these compounds include a silver salt of benzothiazole and a derivative thereof as described in Japanese patent publications Nos. 30270/69 and 18146/70, for example, a silver salt of benzothiazole such as silver salt of methylbenzotriazole, etc., a silver salt of a halogen substituted benzotriazole, such as a silver salt of 5-chlorobenzotriazole, etc., a silver salt of 1,2,4-triazole, of 1H-tetrazole as described in U.S. Pat. No. 4,220,709, a silver salt of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used.

The method used for making silver soap dispersions is well known in the art and is disclosed in *Research Disclosure* April 1983 (22812), *Research Disclosure* October 1983 (23419) and U.S. Pat. No. 3,985,565.

The silver halide and the organic silver salt which are separately formed in a binder can be mixed prior to use to prepare a coating solution, but it is also effective to blend both of them in a ball mill for a long period of time. Further, it is effective to use a process which comprises adding a halogen-containing compound in the organic silver salt prepared to partially convert the silver of the organic silver salt to silver halide.

Methods of preparing these silver halide and organic silver salts and manners of blending them are described in Research Disclosures, No. 170-29, Japanese patent applications No. 32928/75 and 42529/76, U.S. Pat. No. 3,700,458, and Japanese patent applications Nos. 13224/74 and 17216/75.

Preformed silver halide emulsions in the material of this invention can be unwashed or washed to remove soluble salts. In the latter case the soluble salts can be removed by chill-setting and leaching or the emulsion can be coagulation washed, e.g., by the procedures described in Hewitson, et al., U.S. Pat. No. 2,618,556; Yutzy et at., U.S. Pat. No. 2,614,928; Yackel, U.S. Pat. No. 2,565,418; Hart et at., U.S. Pat. No. 3,241,969; and Waller et at., U.S. Pat. No. 2,489,341. The silver halide grains may have any crystalline habit including, but not limited to cubic, tetrahedral, orthorhombic, tabular, laminar, platelet, etc.

Photothermographic emulsions containing preformed silver halide in accordance with this invention can be sensitized with chemical sensitizers, such as with reducing agents; sulfur, selenium or tellurium compounds; gold, platinum or palladium compounds, or combinations of these. Suitable chemical sensitization procedures are described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The Reducing Agent for the Light-Insensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In multilayer constructions, if the reducing agent is added to a layer other than an emulsion layer, slightly higher proportions, of from about 2 to 15 percent, tend to be more desirable.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; a combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyanophenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzene-sulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridine; bisphenols, e.g., bis(2-hydroxy-3-t-butyl-5-methylphenyl)methane; 2,2-bis(4-hydroxy-3-methylphenyl)propane; 4,4-ethylidene-bis(2-t-butyl-6-methylphenol); and 2,2-bis(3,5-dimethyl-4-hydroxyphenyl)propane; ascorbic acid derivatives, e.g., 1-ascorbyl-palmitate, ascorbylstearate and unsaturated aldehydes and ketones, such as benzyl and diacetyl; 3-pyrazolidones; and certain indane-1,3-diones.

The Optional Dye-Releasing Material

As noted above, the reducing agent for the reducible source of silver may be a compound that can be oxidized to form or release a dye.

Leuco dyes are one class of dye releasing material that forms a dye upon oxidation. The optional leuco dye may be any colorless or lightly colored compound that can be oxidized to a colored form, when heated, preferably to a temperature of from about 80° C. to about 250° C. (176° F. to 482° F.) for a duration of from about 0.5 to about 300 seconds and can diffuse through emulsion layers and interlayers into the image receiving layer of the article of the invention. Any leuco dye capable of being oxidized by silver ion to form a visible image can be used in the present invention. Leuco dyes that are both pH sensitive and oxidizable can be used but are not preferred. Leuco dyes that are sensitive only to changes in pH are not included within scope of dyes useful in this invention because they are not oxidizable to a colored form.

As used herein, the term "change in color" includes (1) a change from an uncolored or lightly colored state (optical density less than 0.2) to a colored state (an increase in optical density of at least 0.2 units), and (2) substantial change in hue.

Representative classes of leuco dyes that are suitable for use in the present invention include, but are not limited to, bisphenol and bisnaphthol leuco dyes, phenolic leuco dyes, indoaniline leuco dyes, imidazole leuco dyes, azine leuco dyes, oxazine leuco dyes, diazine leuco dyes, and thiazine leuco dyes. Preferred classes of dyes are described in U.S. Pat. Nos. 4,460,681 and 4,594,307.

One class of leuco dyes useful in this invention are those derived from imidazole dyes. Imidazole leuco dyes are described in U.S. Pat. No. 3,985,565.

Another class of leuco dyes useful in this invention are those derived from so-called "chromogenic dyes." These dyes are prepared by oxidative coupling of a p-phenylenediamine with a phenolic or anilinic compound. Leuco dyes of this class are described in U.S. Pat. No. 4,594,307. Leuco chromogenic dyes having short chain carbamoyl protecting groups are described in assignee's copending application U.S. Ser. No. 07/939,093, incorporated herein by reference.

A third class of dyes useful in this invention are "aldazine" and "ketazine" dyes. Dyes of this type are described in U.S. Pat. Nos. 4,587,211 and 4,795,697.

Another preferred class of leuco dyes are reduced forms of dyes having a diazine, oxazine, or thiazine nucleus. Leuco dyes of this type can be prepared by reduction and acylation of the color-bearing dye form. Methods of preparing leuco dyes of this type are described in Japanese Patent No. 52-89131 and U.S. Pat. Nos. 2,784,186; 4,439,280; 4,563,415, 4,570,171, 4,622,395, and 4,647,525, all of which are incorporated herein by reference.

Another class of dye releasing materials that form a dye upon oxidation are known as preformed-dye-release (PDR) or redox-dye-release (RDR) materials. In these materials the reducing agent for the organic silver compound releases a preformed dye upon oxidation. Examples of these materials are disclosed in Swain, U.S. Pat. No. 4,981,775, incorporated herein by reference.

The optional leuco dyes of this invention, can be prepared as described in H. A. Lubs *The Chemistry of Synthetic Dyes and Pigments;* Hafner; New York, N.Y.; 1955 Chapter 5; in H. Zollinger *Color Chemistry: Synthesis, Properties and Applications of Organic Dyes and Pigments;* VCH; New York, N.Y.; pp. 67–73, 1987, and in U.S. Pat. No. 5,149,807; and EPO Laid Open Application No. 0,244,399.

Dry Silver Formulations

The formulation for the photothermographic emulsion layer can be prepared by dissolving the photosensitive silver halide, the source of reducible silver, the reducing agent for the light-insensitive reducible silver source (as, for example, the optional leuco dye), optional additives, and the thermoreversible organogel binder in an inert organic solvent, such as, for example, toluene, 2-butanone, or tetrahydrofuran.

The use of "toners" or derivatives thereof which improve the image, is highly desirable, but is not essential to the element. Toners may be present in amounts of from 0.01 to 10 percent by weight of the emulsion layer, preferable 0.1 to 10 percent by weight. Toners are well known materials in the photothermographic art as shown in U.S. Pat. Nos. 3,080,254; 3,847,612; and 4,123,282.

Examples of toners include phthalimide and N-hydroxyphthalimide; cyclic imides such as succinimide, pyrazoline-5-ones, and a quinazolinone, 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl-)aryldicarboximides, e.g. (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium)trifluoroacetate and 2-(tribromomethylsulfonyl benzothiazole); and merocyanine dyes such as 3-ethyl-5-[(3-ethyl-2-benzothiazolinylidene)-1-methyl-ethylidene]-2-thio-2,4-oazolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimidine, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

Silver halide emulsions used in this invention may be protected further against the additional production of fog and can be stabilized against loss of sensitivity during keeping. While not necessary for the practice of the invention, it may be advantageous to add mercury (II) salts to the emulsion layer(s) as an antifoggant. Preferred mercury (II) salts for this purpose are mercuric acetate and mercuric bromide.

Suitable antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et at., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Stabilized emulsions used in the invention can contain plasticizers and lubricants such as polyalcohols, e.g., glycerin and diols of the type described in Milton, U.S. Pat. No. 2,960,404; fatty acids or esters such as those described in Robins, U.S. Pat. No. 2,588,765 and Duane, U.S. Pat. No. 3,121,060; and silicone resins such as those described in DuPont British Patent No. 955,061.

The photothermographic elements can include image dye stabilizers. Such image dye stabilizers are illustrated by U.K. Patent No. 1,326,889; U.S. Pat. Nos. 3,432,300 and 3,698,909; U.S. Pat. No. 3,574,627; U.S. Pat. No. 3,573,050; U.S. Pat. No. 3,764,337; and U.S. Pat. No. 4,042,394.

Photothermographic elements containing stabilized emulsion layers can be used in photographic elements which contain light absorbing materials and filter dyes such as those described in Sawdey, U.S. Pat. No. 3,253,921; Gaspar U.S. Pat. No. 2,274,782; Carroll et al., U.S. Pat. No. 2,527,583 and Van Campen, U.S. Pat. No. 2,956,879. If desired, the dyes can be mordanted, for example, as described in Milton, U.S. Pat. No. 3,282,699.

Photothermographic elements containing stabilized emulsion layers can contain matting agents such as starch, titanium dioxide, zinc oxide, silica, polymeric beads including beads of the type described in Jelley et al., U.S. Pat. No. 2,992,101 and Lynn, U.S. Pat. No. 2,701,245.

Stabilized emulsions can be used in photothermographic elements which contain antistatic or conducting layers, such as layers that comprise soluble salts, e.g., chlorides, nitrates, etc., evaporated metal layers, ionic polymers such as those described in Minsk, U.S. Pat. Nos. 2,861,056, and 3,206,312 or insoluble inorganic salts such as those described in Trevoy, U.S. Pat. No. 3,428,451.

The photothermographic dry silver emulsions of this invention may be constructed of one or more layers on a substrate. Single layer constructions should contain the silver source material, the silver halide, the developer, and binder as well as optional materials such as toners, coating aids, and other adjuvants. Two-layer constructions should contain the silver source and silver halide in one emulsion layer (usually the layer adjacent to the substrate) and some of the other ingredients in the second layer or both layers, although two layer constructions comprising a single emulsion layer coating containing all the ingredients and a protective topcoat are envisioned. Multicolor photothermographic dry silver constructions may contain sets of these bilayers for each color or they may contain all ingredients within a single layer as described in U.S. Pat. No. 4,708,928. In the case of multilayer, multicolor photothermographic articles, the various emulsion layers are generally maintained distinct from each other by the use of functional or non-functional barrier layers between the various photosensitive layers as described in U.S. Pat. No. 4,460,681.

Development conditions will vary, depending on the construction used, but will typically involve heating the imagewise exposed material at a suitably elevated temperature, e.g. from about 80° C. to about 250° C., preferably from about 120° C. to about 200° C., for a sufficient period of time, generally from 1 second to 2 minutes.

In some methods, the development is carried out in two steps. Thermal development takes place at a higher temperature, e.g. about 150° C. for about 10 seconds, followed by thermal diffusion at a lower temperature, e.g. 80° C., in the presence of a transfer solvent. The second heating step at the lower temperature prevents further development and allows the dyes that are already formed to diffuse out of the emulsion layer to the receptor layer.

The Support

Photothermographic emulsions used in the invention can be coated on a wide variety of supports. The support or substrate can be selected from a wide range of materials depending on the imaging requirement. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an $\alpha$-olefin polymer, particularly a polymer of an alpha-olefin containing 2 to 10 carbon atoms such as polyethylene, polypropylene, ethylenebutene copolymers and the like. Preferred polymeric materials for the support include polymers having good heat stability, such as polyesters. A particularly preferred polyester is polyethylene terephthalate.

Photothermographic emulsions used in this invention can be coated by various coating procedures including, wire wound rod coating, dip coating, air knife coating, curtain coating, or extrusion coating using hoppers of the type described in U.S. Pat. No. 2,681,294. If desired, two or more layers may be coated simultaneously by the procedures described in U.S. Pat. No. 2,761,791 and British Patent No. 837,095. Typical wet thickness of the emulsion layer can range from about 10 to 250 $\mu$m, preferably, 10 to about 100 micrometers ($\mu$m), and the layer can be dried in forced air at temperatures ranging from 20° C. to 100° C. It is preferred that the thickness of the layer be selected to provide maximum image densities greater than 0.2, and more preferably in the range 0.5 to 2.5, as measured by a MacBeth Color Densitometer Model TD 504 using the color filter complementary to the dye color.

Alternatively, the formulation may be spray-dried or encapsulated to produce solid particles, which can then be redispersed in a second, possibly different, binder and then coated onto the support.

The formulation for the emulsion layer can also include coating aids such as fluoroaliphatic polyesters.

Barrier layers, preferably comprising a polymeric material, may also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica.

The substrate with backside resistive heating layer may also be used in color photothermographic imaging systems such as shown in U.S. Pat. Nos. 4,460,681 and 4,374,921.

The Image-Receiving Layer

The photothermographic dement may further comprise an image-receiving layer. Images derived from the photothermographic elements employing compounds capable of being oxidized to form or release a dye, as for example, leuco dyes are typically transferred to an image-receiving layer.

When the reactants and reaction products of photothermographic systems that contain compounds capable of being oxidized to form or release a dye remain in contact after imaging, several problems can result. For example, thermal development often forms turbid and hazy color images because of dye contamination of the reduced metallic silver image on the exposed area of the emulsion. In addition, the resulting prints tend to develop color in unimaged background areas. This "background stain" is caused by slow reaction between the dye forming or dye releasing compound and reducing agent during storage. It is therefore desirable to transfer the dye formed upon imaging to a receptor, or image receiving layer.

The image-receiving layer of this invention can be any flexible or rigid, transparent layer made of thermoplastic polymer. The image-receiving layer preferably has a thickness of at least 0.1 micrometer, more preferably from about 1 to about 10 micrometers, and a glass transition temperature of from about 20° C. to about 200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, cellulose propionate; polystyrene; polyvinyl chloride; polyvinylidine chloride; polyvinyl acetate; copolymer of vinylchloride-vinylacetate; copolymer of vinylidene chloride-acrylonitrile; copolymer of styrene-acrylonitrile; and the like.

The optical density of the dye image and even the actual color of the dye image in the image-receiving layer is very much dependent on the characteristics of the polymer of the image-receiving layer, which acts as a dye mordant, and, as such, is capable of absorbing and fixing the dyes. A dye image having a reflection optical density in the range of from 0.3 to 3.5 (preferably from 1.5 to 3.5) or a transmission optical density in the range of from 0.2 to 2.5 (preferably from 1.0 to 2.5) can be obtained with the present invention.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer may be strippably adhered to the photothermographic element. Strippable image receiving layers are described in U.S. Pat. No. 4,594,307, incorporated herein by reference.

Selection of the binder and solvent to be used in preparing the emulsion layer significantly affects the strippability of the image-receiving layer from the photosensitive element. Preferably, the binder for the image-receiving layer is impermeable to the solvent used for coating the organogel emulsion layer and is incompatible with the binder used for the organogel emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of from about 0.02 to about 0.5 weight percent of the emulsion layer, preferably from about 0.1 to about 0.3 weight percent. A representative example of such a fluoroaliphatic polyester is "Fluorad FC 431", (a fluorinated surfactant available from 3M Company, St. Paul, Minn.). Alternatively, a coating additive can be added to the image-receiving layer in the same weight range to enhance strippability. No solvents need to be used in the stripping process. The strippable layer preferably has a delaminating resistance of 1 to 50 g/cm and a tensile strength at break greater than, preferably at least two times greater than, its delaminating resistance.

Preferably, the image-receiving layer is adjacent to the emulsion layer to facilitate transfer of the dye that forms after the imagewise exposed emulsion layer is subjected to thermal development, for example, in a heated shoe and roller type heat processor.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Multi-layer constructions containing blue-sensitive emulsions containing a yellow leuco dye may be overcoated with green-sensitive emulsions containing a magenta leuco dye. These layers may in turn be overcoated with a red-sensitive emulsion layer containing a cyan leuco dye. Imaging and heating form the yellow, magenta, and cyan images in an imagewise fashion. The dyes so formed may migrate to an image-receiving layer. The image-receiving layer may be a permanent part of the construction or may be removable, "i.e., strippably adhered" and subsequently peeled from the construction. Color-forming layers may be maintained distinct from each other by the use of functional or non-functional barrier layers between the various photosensitive layers as described in U.S. Pat. No. 4,460,681. False color address, such as that shown in U.S. Pat. No. 4,619,892, may also be used rather than blue-yellow, green-magenta, or red-cyan relationships between sensitivity and dye formation.

In another embodiment, the colored dye released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of from 0.5 to 300 seconds at a temperature of from about 80° C. to about 220° C.

Alternatively, a multi-colored image may be prepared by superimposing in register a single-image-receiving sheet successively with two or more imagewise exposed photothermographic or thermographic elements, each of which release a dye of a different color, and heating to transfer the released dyes as described above. This method is particularly suitable for the production of color proofs especially when the dyes released have hues which match the internationally-agreed standards for color reproduction (SWOP colors). Dyes with this property are disclosed in U.S. Pat. No. 5,023,229. In this embodiment, the photothermographic or thermographic element preferably comprise compounds capable of being oxidized to release a preformed dye as this enables the image dye absorptions to be tailored more easily to particular requirements of the imaging system. When used in a photothermographic element, the elements are preferably all sensitized to the same wavelength range regardless of the color of the dye released. For example, the elements may be sensitized to ultra-violet radiation with a view toward contact exposure on conventional printing frames, or they may be sensitized to longer wavelengths, especially red or near infrared to enable digital address by lasers.

Objects and advantages of this invention will now be illustrated by the following examples, but the particular materials and amounts thereof recited in these examples, as well as other conditions and details, should not be construed to unduly limit this invention. All percentages are by weight unless otherwise indicated.

EXAMPLES

Materials used in the following examples were available from standard commercial sources such as Aldrich Chemical Co. (Milwaukee, Wis.) unless otherwise specified.

The term "PET" means poly(ethylene terephthalate).

The term "MEK" means methyl ethyl ketone (2-butanone).

The term "PAZ" means 1-(2H)-phthalazinone.

Butvar TM refers to poly(vinyl butyral) polymers available from Monsanto Company, St. Louis, Mo.).

Dye A has the following formula:

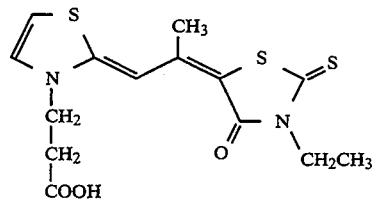

Dye B is disclosed in U.S. Pat. No. 4,123,282 and has the following formula:

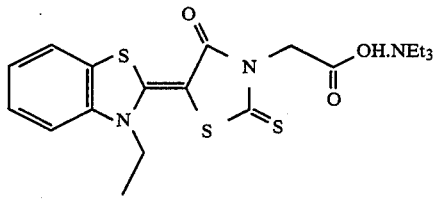

"Ethyl ketazine" has the following formula:

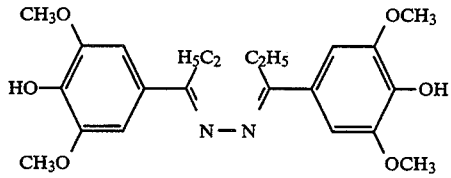

"Hydroxy cyan" has the following formula:

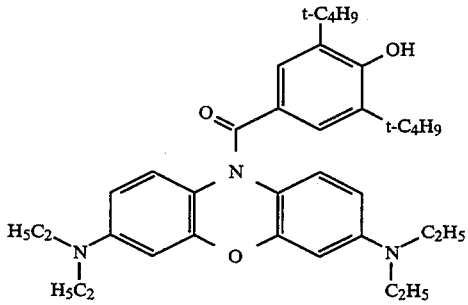

"Pergascript Turquoise TM" is available from Hilton Davis, Inc., Cincinnati, Ohio and is believed to have the following formula:

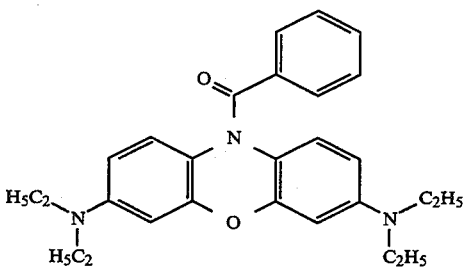

A double-knife coater was used to coat the organogel emulsions. In order to be able to coat heated solutions (required for molten gel coating) the coater bed and knives were provided with resistance heating. The temperature of the bed and knives was regulated to be at least 10° C. above $T_{gel}$ of the dispersion.

If desired, a chill box may be used to promote rapid gelation. For example, a chill box measuring 90 cm×35 cm×20 cm deep with an aluminum plate resting on a bed of dry ice, and provided with a styrofoam lid may be used. Once the coating is made, it may be placed on the aluminum plate to chill-set the organogel.

The substrate used was 0.102 mm white pigmented polyester, 30.5 cm wide, overcoated with a polyvinylidene chloride copolymer layer that allowed for the release of the coating so that clear cross-section photomicrographs could be taken of the coated layers. In order to promote release of the coating, a surfactant as described previously, was added to solution #1 at a concentration of 1% of the mass of the binder. This was introduced as a 10% solution in a solvent blend identical to the blend used in the coating solution.

The substrate was cut to a length suitable to the volume of solution used, ca. 75 cm, and after raising the hinged knives, placed in position on the warm coater bed. The knives were then lowered and locked into place. The height of the knives was adjusted with wedges controlled by screw knobs and measured with electronic gauges. The knives were zeroed onto the substrate and knife #1 was raised to a clearance corresponding to the desired wet thickness of layer #1 (0.152 mm). Knife #2 was raised to a height equal to the desired wet thickness of layer #1 plus the desired wet thickness of layer #2 (0.304 mm).

Aliquots of each coating solution (10 ml) were maintained at 60° C. in a thermostatted water bath. As soon as the setup was complete, aliquots of solutions #1 and #2 were simultaneously poured onto the warm substrate in front of the corresponding knives. The substrate was immediately drawn past the knives so that a double coating was produced. The coated substrate was immediately placed in the chill box which was then closed.

The following examples demonstrate the preparation of non-aqueous, two-layer silver-containing photothermographic constructions according to the method of the present invention whereby the two layers are coated simultaneously. In these examples, the first layer in the construction contains silver halide, an organic silver salt, sensitizing dye, and a leuco dye. The second layer contains an activator for the oxidation of the leuco dye. The two layers are made up of the same solvent and binder.

EXAMPLE 1

This example demonstrates the use of organogels as binders for black and white photothermographic constructions.

To a 250 ml 3-necked flask provided with mechanical stirring, electric heating mantle, and a reflux condenser was added 100 g of a homogenate consisting of (wt/wt) 10% silver behenate half-soap, 45% toluene and 45% MEK. Under red safe lights, a solution consisting of 0.06 g $HgBr_2$ in 4 ml toluene and 4 ml MEK was added to the solution and allowed to stir for 1.5 hours. 5.85 g Butvar TM B-74 was added to the rapidly stirring solution and then the temperature was raised to 50° C. for 1 hour to ensure complete dissolution of the binder. At room temperature, the mixture formed a gel. A second solution was made by adding 2.5 g Butvar TM B-74 to a rapidly stirred solution of 25 ml toluene and 25 ml MEK. The temperature was raised to 50° C. until the binder was dissolved. To this was added 0.2 g PAZ, 0.2 g CAO-5 and 2 drops FC-431.

A two layer knife coating was made as described. A white light exposure for on an EG&G Sensitometer for $10^{-3}$ using a Xenon flash through a continuous wedge and subsequent thermal development at 128° C. for 20 seconds gave a black image in the exposed areas.

EXAMPLE 2

To a jacketed round bottomed flask fitted with overhead stirring, reflux condenser, and a cooling and heating water bath was added 27.6 g of a 10% (wt/wt) silver behenate half-soap in toluene/acetone (90/10) 58 ml MEK. 14 ml toluene was added and the solution was allowed to stir for 20 minutes. To this was added 0.06 g mercuric bromide in 8 ml MEK/toluene (40/60) and the mixture was stirred for two hours and 4.5 g of Butvar TM B-74 was added. The temperature was raised to a maximum of 55° C. and maintained for one hour to ensure complete dissolution of the binder. 0.0008 g of Dye A (a green sensitizing dye) and 0.40 g Pergascript Turquoise TM (a cyan leuco dye available from Hilton Davis, Cincinnati, Ohio) was dissolved in 8 ml of toluene/MEK (40/60) and added to the above solution. This was allowed to stir for one minute and simultaneously coated on a knife coater with a 4 mil (101 μm) gap for each layer with a topcoat consisting of 5.0 g Butvar TM B-74 and 1.0 g 4-methyl phthalic acid in 100 ml of 40/60 toluene/MEK. The solutions as well as the coater were maintained at 45° C. to prevent premature gelation. The coating gelled shortly after removal from the knife coater. It was allowed to air dry for ten minutes and then oven dried at 80° C. for four minutes. A 2.54×12.7 cm strip was cut and exposed lengthwise through a step wedge with an EG&G sensitometer with a Wratten 58 green filter for $10^{-3}$ seconds, and then processed at 138° C. for twenty seconds in a 3M Model 9014 Dry Silver Processor. The resultant image had a $D_{max}$ of 1.97 and a $D_{min}$ of 0.30.

EXAMPLE 3

This example demonstrates the preparation of a cyan monochrome. A first coating solution was prepared as follows:

A silver premix was prepared by mixing 3200 g of a dispersion consisting of 5 wt % silver behenate, 5 wt % behenic acid, 81 wt % toluene, 9 wt % acetone, 1400 g toluene, and 5460 g MEK at room temperature until uniform. Under red light, 3.470 g $HgBr_2$ in 100 g toluene and 280 g MEK was added to make the light sensitive AgBr dispersion. The dispersion was mixed for two hours and Butvar TM B-74 (520 g) was slowly added and stirred until dispersed. The temperature was increased to 50° C., and mixed for two hours to dissolve the Butvar TM B-74. The resultant warm silver premix was poured into a jacketed kettle in preparation for coating. The solution was stored at room temperature and was in a gel state.

A dye solution was prepared at room temperature by mixing 361.0 g toluene, 506.0 g MEK, 46.43 g hydroxycyan, and 0.045 g Dye A. This solution was placed into a second kettle and was mixed in-line with the first solution prior to coating.

A second coating formulation was prepared as follows: toluene (4420 g) and 5350 g MEK were mixed at room temperature and 637.0 g of Butvar TM B-74 was slowly added and dispersed. The temperature was increased to 50° C. and mixed for two hours to dissolve the Butvar TM B-74. The warm solution was poured into a third kettle and allowed to cool to room temperature during storage. The solution was a gel. Just prior to coating, 1280 g 4-methylphthalic acid dissolved in 805.0 g MEK and a mixture of 3.185 g of FC-431 TM, 5.0 g MEK, and 3.5 toluene were added to the remelted solution.

Prior to coating, the solutions in the jacketed kettles were brought to 50° C. The first and second layers were coated using a slide die of the type disclosed in U.S. Statutory Invention Registration H1003, which was heated with circulating water to 50° C. The layers were coated simultaneously at a thickness of 0.102 mm for each layer and at web speeds of 0.5 to 2.0 m/sec. The coatings, once on the web, were chilled by ambient conditions or by contact with a cold plate. A sample was coated at 0.5 m/sec, cooled, and dried at ambient conditions. Samples, exposed using an EG&G sensitometer, and developed at 137° C. for 10 sec, exhibited the following sensitometric properties:

| Light Exposure | $D_{min}$ | $D_{max}$ |
|---|---|---|
| Green ($10^{-3}$ Seconds) | 0.17 | 0.39 |
| White ($10^{-3}$ Seconds) | 0.16 | 0.85 |

EXAMPLE 4

This example demonstrates the preparation of a magenta monochrome. A first coating solution was prepared as follows:

A carrier layer coating solution was prepared by mixing 581.0 g toluene and 809.0 g MEK at room temperature. The mixture was cooled to 10° C. and 7.5 g Butvar TM B-98 was added and dispersed. The temperature was raised to 50° C. to dissolve the Butvar TM B-98. The resulting carrier layer coating solution was stored in a first jacketed kettle to await coating.

A silver premix was prepared by mixing 3600 g of a dispersion consisting of 5 wt % silver behenate, 5 wt % behenic acid, 45 wt % toluene, and 1870 g MEK at room temperature until uniform. Under red light, 4.320 g $HgBr_2$ in 202.0 g toluene and 432.0 g MEK was added to make the light sensitive AgBr dispersion. The dispersion was mixed for two hours and 874.9 g of Butvar TM B-98 was slowly added and stirred until dispersed. The temperature was increased to 50° C., and mixed for one hour to dissolve the Butvar TM B-74. The resultant warm silver premix was poured into a second jacketed kettle in preparation for coating. The solution was stored at room temperature and was in a gel state.

A dye solution was prepared at room temperature by mixing 890.4 g 1,3-dioxolane, 2704.8 g MEK, and 78.000 g toluene and 336.0 g of Butvar TM B-98 was added and dispersed. The temperature of the dispersion was raised to 50° C. and the dispersion was mixed until the polymer dissolved. 45.83 g of ethyl ketazine and 0.217 g of Dye A were added and dissolved in the mixture. This dye solution was poured into a third jacketed kettle to await coating. The silver premix in the second kettle and the dye solution in the third kettle were mixed in-line.

A topcoat coating layer was prepared by mixing 4065 g toluene and 5660 g MEK at room temperature. 939.0 g of Butvar TM B-98 was slowly added and dispersed. The temperature of the dispersion was raised to 50° C. and mixed for one hour to dissolve the Butvar TM B-98. 173.0 g of PAZ, 3,500 g toluene, 5,000 g MEK, and 4.695 g FC-431 TM were added and mixed until dissolved. The warm solution was poured into a fourth kettle and allowed to cool to room temperature during storage. The solution was a gel at room temperature.

Prior to coating, the solutions in the jacketed kettles were brought to 50° C. The three layers were coated using a slide die of the type disclosed in U.S. Statutory Invention Registration H1003 which was heated with circulating water to 47.2° C. The layers were coated simultaneously at a thickness of 0.102 mm/layer, and at web speeds of 0.58 to 2.03 m/sec. The carder layer was on the bottom, the silver layer in the middle, and the PAZ layer on the top. The coatings, once on the web, were chilled by ambient conditions or by contact with a cold plate. A sample was coated at 1.02 m/sec., cooled, and dried. A sample, exposed using an EG&G sensitometer with a Wratten 58 green filter and developed at 137° C. for 20 sec, exhibited the following sensitometric properties:

| Light Exposure | $D_{min}$ | $D_{max}$ |
|---|---|---|
| Green ($10^{-3}$ seconds) | 0.14 | 1.19 |

EXAMPLE 5

A 10% half-soap 50/50 (wt/wt) toluene/MEK was used in place of the half-soap of Example 4. The half-soap (14.8 g) was combined with 32.5 g MEK and 21.5 g toluene and stirred for twenty minutes. Mercuric bromide (0.015 g) in 0.3 g toluene/MEK (40/60) was added and stirred for two hours. Zinc bromide (0.015 g) in 0.5 g toluene/MEK (40/60) was added and stirred for one hour. Butvar TM B-74 (4.16 g) was added as described herein previously. Just prior to coating, a solution containing 0.60 g of 2-(3,5-di-tert-butyl-4-hydroxy)-4,5-diphenylimidazole), 0.002 g Dye B (a blue sensitizing dye), and 31.5 g toluene/MEK (40/60) was added and coated and dried as described in Example 4. The topcoat used a contained 1.5 g PAZ instead of the 4-methylphthalic acid. A sample, exposed using an EG&G sensitometer with a Wratten 47B blue filter, produced an image with a $D_{max}$ of 1.4 and $D_{min}$ of 0.10 upon development.

EXAMPLES 6–9

Examples 6–9 were done using two different types of poly(vinyl butyral). Butvar TM B-72 has a poly(vinyl alcohol) content of 17.5 to 21.0 wt. % and Butvar TM B-76 has a poly(vinyl alcohol) content of 9.0 to 13.0 wt. %.

EXAMPLE 6

66.6 ml methanol, 66.6 ml acetone, 66.6 ml toluene, 16.0 g silver behenate, 12.8 g behenic acid, and 6.0 g poly(vinyl butyral) were combined in a quart jar. ½" glass balls were added to just below the liquid surface and placed on rollers at a rate of 90 rpm for 72 hours. The liquid was decanted and 40 ml acetone, 40 ml toluene, and 40 ml methanol were added and stirred for 1 hour. 3 ml of the above solution was added with stirring to 7.0 ml of a solution of 0.0208 g 4-phenylazo-4-phenol dissolved in a 2.5% by weight solution of poly(vinyl butyral) in methyl ethyl ketone.

Neither the Butvar TM B-72 nor B-76 would form a gel under the foregoing conditions.

EXAMPLE 7

100 ml toluene, 100 ml methanol, 16.8 g silver behenate, 12.8 g behenic acid, and 6.0 g poly(vinyl butyral) were combined in a quart jar. Glass balls were added and milled as described in Example 6. The liquid was decanted and 68.8 ml toluene and 68.8 ml methanol were added and stirred for one hour. 3 ml of above solution was added, with stirring, to 6.0 ml of a solution of 2.5 % by weight poly(vinyl butyral) in 1:1 toluene:-MEK (vol) in which was dissolved 0.003 g phthalimide and 0.0779 g 2-(3-5-di-t-butyl-4-hydroxyphenyl)-4,5-diphenylimidazole. A solution of 0.0185 g poly(vinyl butyral) in 1.0 ml acetone was added.

Neither the Butvar TM B-72 nor B-76 would form a gel under the foregoing conditions.

EXAMPLE 8

3 ml of the first solution described in Example 7 was added, with stirring, to 6.0 ml of a solution of 2.5% by weight poly(vinyl butyral) in 1:1 toluene:MEK (vol) in which was dissolved 0.0775 g leuco Malachite Green, 0.0532 g hydroquinone, 0.003 g phthalimide, and 0.632 g methyl stearate.

Neither the Butvar TM B-72 nor B-76 would form a gel under the foregoing conditions.

EXAMPLE 9

0.16 g poly(vinyl butyral) was dissolved in 5.0 ml 1:1 toluene:acetone (vol). A solution of 0.01 g leuco Malachite Green in 5.0 ml MEK and a solution of 0.008 g hydroquinone in 5.0 ml ethanol were then added.

Prior to adding the MEK and ethanol solutions, the toluene/acetone solution was very viscous and required heat to dissolve the Butvar TM B-72. When cooled, the solutions gelled, but after addition of the MEK and ethanol solutions, it became free-flowing.

Although not wishing to be bound by theory, it is believed that in Examples 6–9 the addition of methanol or other alcohols to poly(vinyl butyral) prevents or reverses gel formation because of the hydrogen bonding of the poly(vinyl alcohol) sites of poly(vinyl butyral) with alcohol-based solvents.

Reasonable modifications and variations are possible from the foregoing disclosure without departing from either the spirit or scope of the present invention as defined in the claims.

We claim:

1. A photothermographic emulsion comprising:
   (a) a photosensitive silver halide;
   (b) a light-insensitive, reducible source of silver;
   (c) a reducing agent for said light-insensitive, reducible source of silver; and
   (d) a binder, which is a thermoreversible organogel, consisting essentially of poly(vinyl butyral) having a poly(vinyl alcohol) content of from about 17.5 to 21.0 wt. % and at least one solvent selected from the group consisting of: toluene, methyl ethyl ketone, acetone, tetrahydrofuran, and 1,4-dioxane.

2. The emulsion according to claim 1 wherein said silver halide is silver bromide, silver chloride, or silver iodide or mixtures thereof.

3. The emulsion according to claim 1 wherein said reducible source of silver is a silver salt of a $C_{10}$ to $C_{30}$ carboxylic acid.

4. The emulsion according to claim 1 wherein said reducible source of silver is a complex of organic or inorganic salts wherein the ligand has a gross stability constant for silver ion of between 4.0 and 10.0.

5. The emulsion according to claim 1 wherein said reducing agent is a compound capable of being oxidized to form or release a dye.

6. The emulsion according to claim 5 wherein said reducing agent is a leuco dye.

7. The emulsion according to claim 1 wherein the $T_{gel}$ of said thermoreversible organogel is between about 20° C. and 70° C.

8. A process of coating a substrate comprising the steps of:

(a) heating at least one thermoreversible organogel to a temperature of from 5° to 25° C. above the $T_{gel}$ of said thermoreversible organogel to a liquid or molten state and then applying a layer of said at least one liquid molten thermoreversible organogel to a substrate, said at least one liquid or molten thermoreversible organogel comprising:

(i) a photosensitive silver halide;

(ii) a light-insensitive reducible silver source;

(iii) a reducing agent for said light-insensitive reducible silver source; and (iv) a binder consisting essentially of: poly(vinyl butyral) having a poly(vinyl alcohol) content of from about 17.5 to 21.0 wt. % and at least one solvent selected from the group consisting of: toluene, methyl ethyl ketone, acetone, tetrahydrofuran, and 1,4-dioxane;

(b) chilling said at least one liquid or molten thermoreversible organogel layer to a temperature below its $T_{gel}$, thereby causing it to gel; and (c) removing residual solvent.

9. The process according to claim 8 wherein said reducing agent for said light-insensitive silver source is a compound capable of being oxidized to form or release a dye.

10. The process according to claim 9 wherein said reducing agent for said light-insensitive silver source is a leuco dye.

11. The process according to claim 8 wherein said silver halide is silver bromide, silver chloride, or silver iodide or mixtures thereof.

12. The process according to claim 8 wherein said reducible source of silver is a silver salt of a $C_{10}$ to $C_{30}$ carboxylic acid.

13. The process according to claim 8 wherein said reducible source of silver is a complex of organic or inorganic salts wherein the ligand has a gross stability constant for silver ion of between 4.0 and 10.0.

14. The process according to claim 8 wherein the $T_{gel}$ of said liquid or molten thermoreversible organogel layer is between about 20° C. and 70° C.

15. The process according to claim 8 wherein said chilling occurs at a temperature of from 0° C. to −70° C.

* * * * *